US009314090B1

(12) United States Patent
Manning et al.

(10) Patent No.: US 9,314,090 B1
(45) Date of Patent: Apr. 19, 2016

(54) HAMMOCK TENT

(71) Applicants: Daniel James Manning, Shell Lake, WI (US); Justin Michael Weise, Madison, WI (US)

(72) Inventors: Daniel James Manning, Shell Lake, WI (US); Justin Michael Weise, Madison, WI (US)

( * ) Notice: Subject to any disclaimer, the term of this patent is extended or adjusted under 35 U.S.C. 154(b) by 0 days.

(21) Appl. No.: 14/549,579

(22) Filed: Nov. 21, 2014

Related U.S. Application Data

(60) Provisional application No. 61/918,526, filed on Dec. 19, 2013.

(51) Int. Cl.
*A45F 3/22* (2006.01)
*E04H 15/04* (2006.01)

(52) U.S. Cl.
CPC . *A45F 3/22* (2013.01); *E04H 15/04* (2013.01)

(58) Field of Classification Search
CPC ..... A45F 3/22; A45F 3/24; A47C 17/84; A47C 29/00; A47C 29/003; A47C 29/006; E04H 15/04; E04H 15/324
See application file for complete search history.

(56) References Cited

U.S. PATENT DOCUMENTS 326,321 A * 9/1885 Nickerson ..... A45F 3/22 5/121
329,763 A * 11/1885 Nelmes et al. ..... A45F 3/22 5/121
495,366 A * 4/1893 Perry ..... A45F 3/22 5/121
4,686,720 A * 8/1987 Newell ..... A45F 3/22 5/121
5,113,537 A * 5/1992 Turk ..... A45F 3/22 135/90
5,564,454 A 10/1996 Curley et al.
7,699,068 B2 4/2010 Helsdon
8,161,991 B2 4/2012 Johnson
8,356,370 B1 * 1/2013 Clark ..... A45F 3/22 5/120
8,485,209 B2 7/2013 Imhof
2008/0199336 A1 * 8/2008 Brensinger ..... A63B 29/02 417/472
2012/0060881 A1 * 3/2012 Ly-Cho ..... E04H 1/1244 135/121

* cited by examiner

*Primary Examiner* — Nicholas Polito
(74) *Attorney, Agent, or Firm* — Donald J. Ersler

(57) ABSTRACT

A hammock tent preferably includes a hammock, a tubular tent and two pole anchors. The hammock includes a hammock portion, a first attachment structure and a second attachment structure. The tubular tent includes a tubular member and a cone member. The tubular member includes a tube portion, a first end portion, a second end portion and a spiral spring. The tube portion preferably includes a fabric tube, a fabric door, a bottom lengthwise screen and at least one screen window. The hammock is inserted through the tubular tent and the cone member. The first and second attachment structures are attached to first and second elevated structures. The user lies in the hammock and preferably pulls the normally collapsed tubular tent into an elongated orientation with the at least one pull string. The cone member is finally pulled into the tubular member.

13 Claims, 8 Drawing Sheets

HAMMOCK TENT

CROSS-REFERENCES TO RELATED APPLICATIONS

This is a non-provisional application taking priority from provisional application No. 61/918,526 filed on Dec. 19, 2013.

BACKGROUND OF THE INVENTION

1. Field of the Invention

The present invention relates generally to camping gear and more specifically to a hammock tent, which provides a sleeping structure that does not contact the ground.

2. Discussion of the Prior Art

U.S. Pat. No. 5,564,454 to Curley et al. discloses a collapsible toy and outdoor structure. U.S. Pat. No. 7,699,068 to Helsdon discloses a hammock tent. U.S. Pat. No. 8,161,991 to Johnson discloses a multipurpose camping hammock. U.S. Pat. No. 8,485,209 to Imhof discloses a mosquito spring net.

Accordingly, there is a clearly felt need in the art for a hammock tent, which provides a sleeping structure that does not contact the ground and encloses the user in a tubular tent structure.

SUMMARY OF THE INVENTION

The present invention provides a hammock tent, which provides a sleeping structure that does not contact the ground. The hammock tent preferably includes a hammock, a tubular tent and two pole anchors. The hammock includes a hammock portion a first attachment structure and a second attachment structure. The hammock portion is preferably fabricated from a fabric material, which is sewn to form a shape similar to a canoe. Each pole anchor preferably includes a fabric strip and a hook fastener pad, a loop fastener pad. A middle portion of the fabric strip is folded over and attached to itself to form a strip loop, a first leg and a second leg. The hook or loop fastener pad is attached to an outside of the first leg and the loop or hook fastener pad is attached to an inside of the second leg. The first attachment structure extends from a first end of the hammock portion and the second attachment structure extends from a second end of the hammock portion. Each attachment structure preferably includes a rope loop. An S-hook is preferably used to secure the rope loop to the strip loop.

The tubular tent includes a tubular member and a cone member. The tubular member includes a tube portion, a first end portion, a second end portion and a spiral spring. The tube portion preferably includes a fabric tube, a fabric door, a bottom lengthwise screen, at least one screen window and at least one drawstring. An outer perimeter of the spiral spring is sized to be received by an inner perimeter of the fabric tube. The spiral spring is placed inside the fabric tube. The fabric tube is looped over the spiral spring along a length of the fabric tube and the loop sewn to retain coils of the spiral spring substantially equal spaced along a length of the fabric tube. The spiral spring causes the tubular tent to normally have a collapsed orientation. The bottom lengthwise screen is sewn into a bottom of the fabric tube. The first end portion is sewn into a first end of the fabric tube and the second end portion is sewn into a second end of the fabric tube. The at least one screen window is sewn into the fabric tube, adjacent the second end of the fabric tube. The fabric door is positioned adjacent the at least one screen window. The fabric door will cover the at least one screen window in a closed position. One end of the at least one pull string is attached to a first end of the fabric tube or to the first end portion. The at least one pull string extends substantially a length of the fabric tube. The other end of the at least one pull string is releasably secured to substantially a second end of the fabric tube.

The first end portion includes a circular outer perimeter and a first inner perimeter. The first inner perimeter is sized to allow the first attachment structure to be pulled therethrough. A hammock pull string is sewn into the first inner perimeter for cinching around the first attachment structure. The second end portion includes a circular outer perimeter and a second inner perimeter. The second inner perimeter is sized to receive a portion of the cone member. The second inner perimeter is sewn around an elastic material.

The cone member preferably includes a fabric cone, a round support ring and a cone drawstring. The round support ring is sewn into an outer perimeter of the fabric cone. A cone inner perimeter is formed in the fabric cone. The cone drawstring is sewn into the cone inner perimeter. The cone drawstring is used to cinch around the second attachment structure.

In use, the two pole anchors are attached to two trees or the like, which have a distance greater than a length of the hammock. The hammock is inserted through the tubular tent and the cone member. The first attachment structure of the hammock is attached to a first tree and the second attachment structure of the hammock is attached to a second tree. The user lies in the hammock and pulls the normally collapsed tubular tent into an elongated orientation with the at least one pull string. The cone member is pulled through the second inner perimeter of the fabric tube. Once the cone member is positioned, the cone drawstring is cinched and tightened around the second attachment structure. To leave the tubular tent, the cone member is pushed out of the second inner perimeter and the at least one pull string is detached from an inside of the fabric tube.

Accordingly, it is an object of the present invention to provide a hammock tent, which provides a sleeping structure that does not contact the ground and encloses the user in a tubular tent structure.

These and additional objects, advantages, features and benefits of the present invention will become apparent from the following specification.

DETAILED DESCRIPTION OF THE PREFERRED EMBODIMENTS

Figure 5:
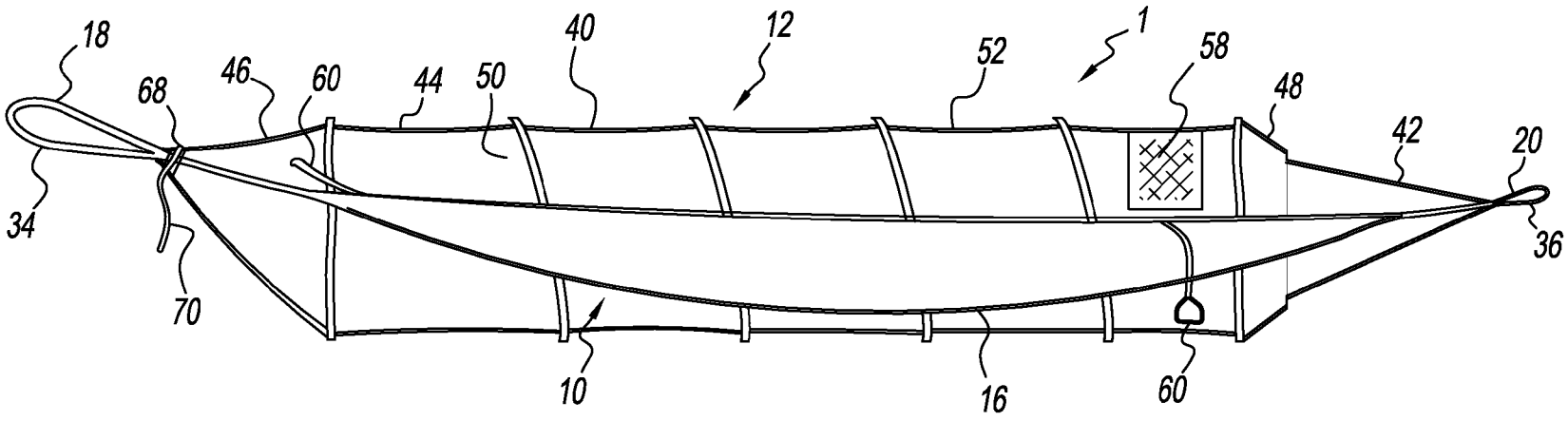
FIG. 5 is a side cross sectional view of a hammock tent in accordance with the present invention.
Figure 6:
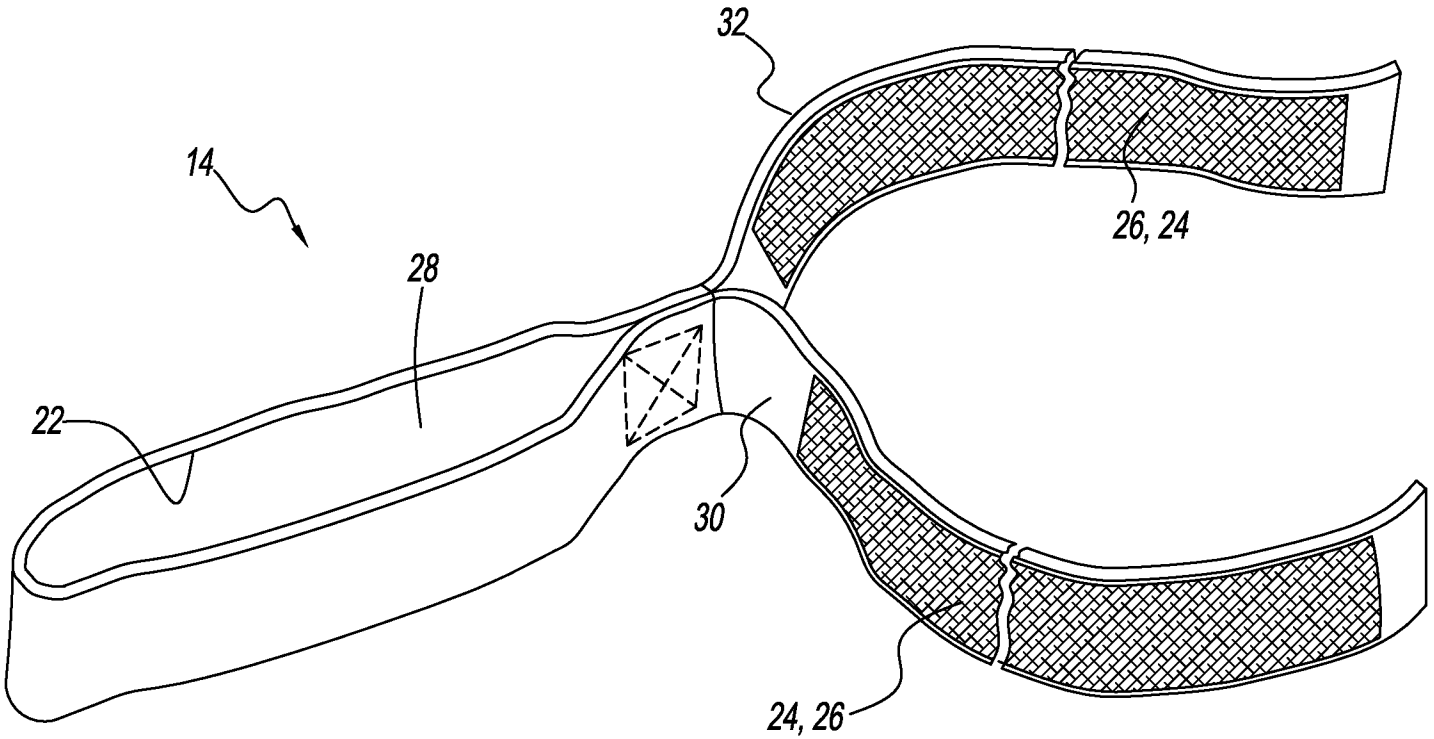
FIG. 6 is a perspective view of a pole anchor of a hammock tent in accordance with the present invention.
Figure 7:
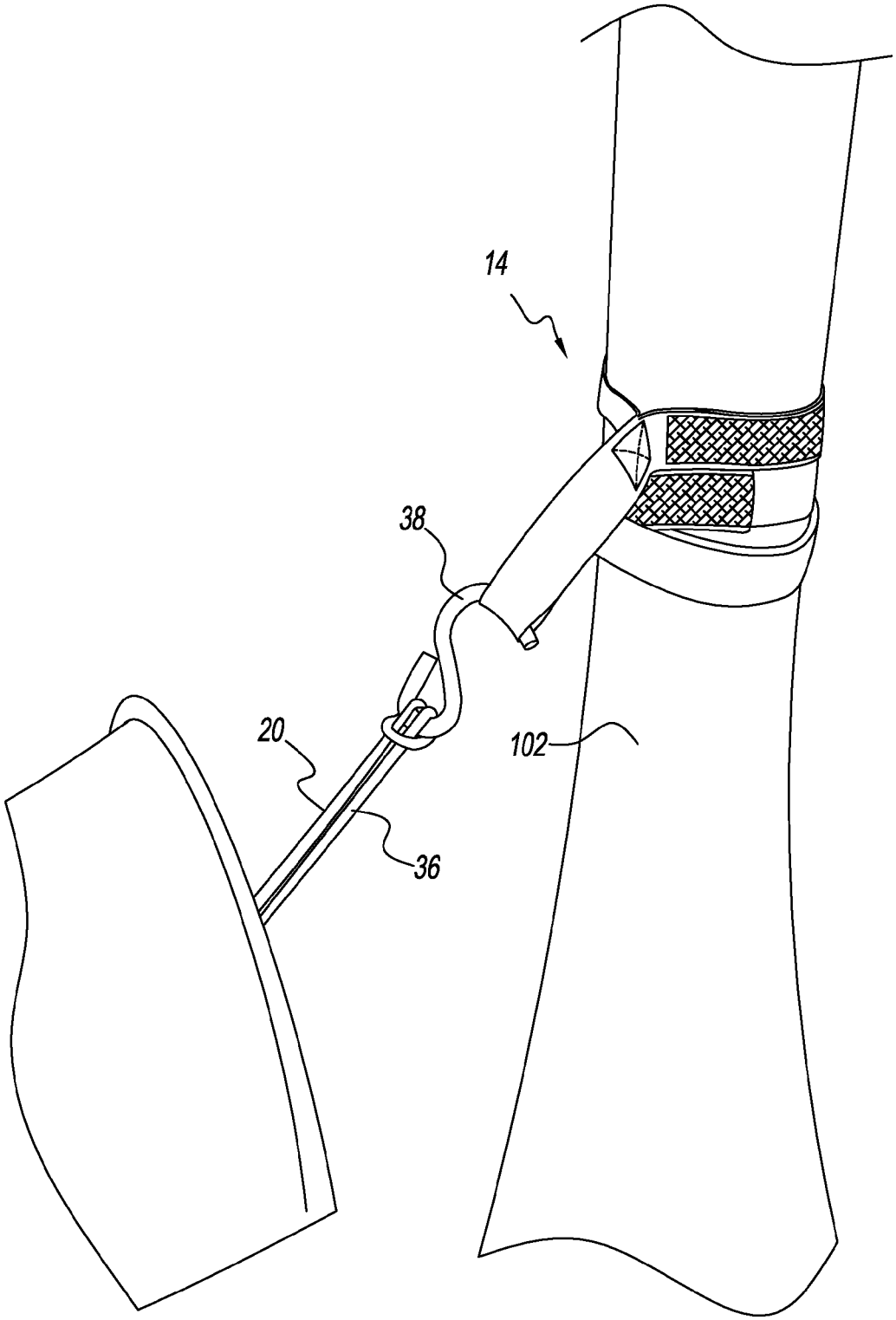
FIG. 7 is an enlarged perspective view of a pole anchor retaining a second attachment structure of a hammock tent in accordance with the present invention.

With reference now to the drawings, and particularly to FIG. 5, there is shown a cross sectional view of a hammock tent 1. With reference to FIGS. 1-4, the hammock tent 1 preferably includes a hammock 10, a tubular tent 12 and two pole anchors 14. The hammock 10 includes a hammock portion 16 a first attachment structure 18 and a second attachment structure 20. The hammock portion 16 is preferably fabricated from a fabric material, which is sewn to form a shape, similar to a canoe. The hammock portion 16 is capable of supporting at least one adult person. With reference to FIG. 6, each pole anchor 14 preferably includes a fabric strip 22, a hook fastener pad 24 and a loop fastener pad 26. A middle portion of the fabric strip 22 is folded over and attached to itself to form a strip loop 28, a first leg 30 and a second leg 32. The fabric strip 22 is preferably attached to itself with sewing, but other attachment methods may also be used. The hook or loop fastener pad 24, 26 is attached to an outside surface of the first leg 30 and the loop or hook fastener pad 26, 24 is attached to an inside surface of the second leg 32. The first attachment structure 18 extends from a first end of the hammock portion 16 and the second attachment structure 20 extends from a second end of the hammock portion 16. Each attachment structure 18, 20 preferably includes a rope loop 34, 36. With reference to FIG. 7, an S-hook 38 is preferably used to secure the rope loop 34, 36 to the strip loop 28.

Figure 1:
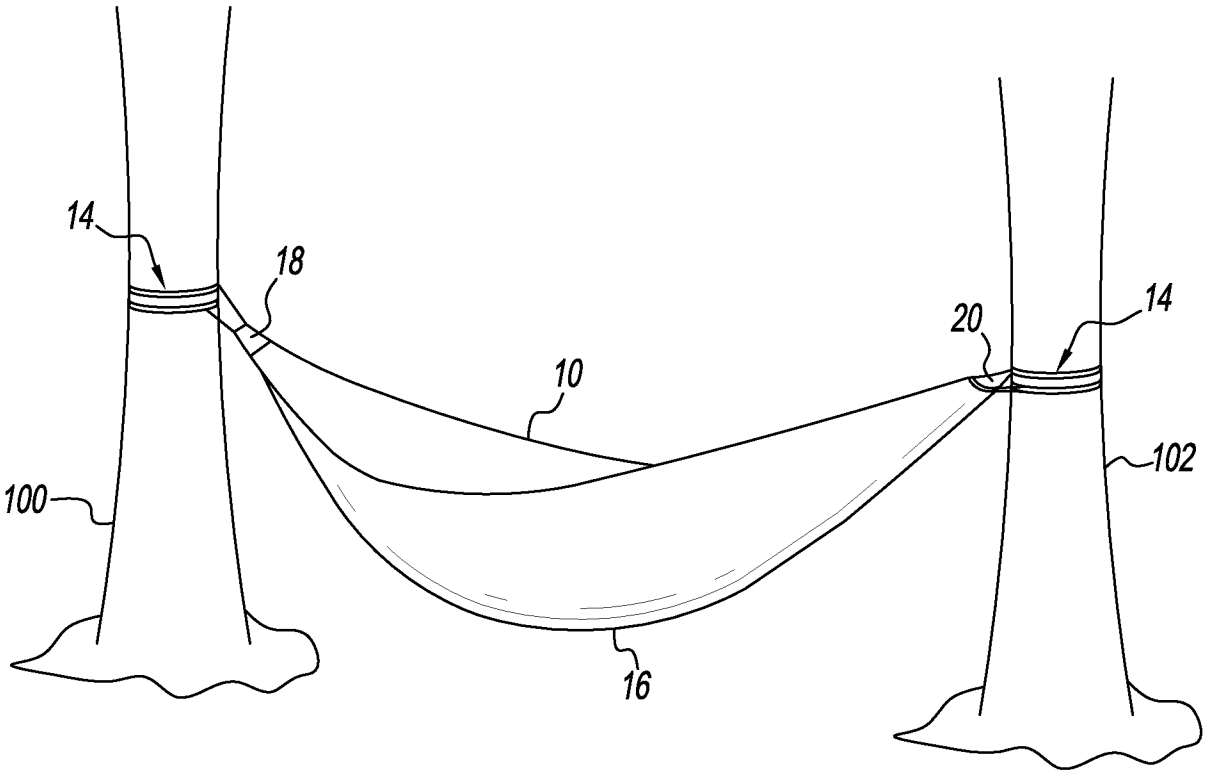
FIG. 1 is a perspective view of a hammock secured between two trees of a hammock tent in accordance with the present invention.
Figure 2:
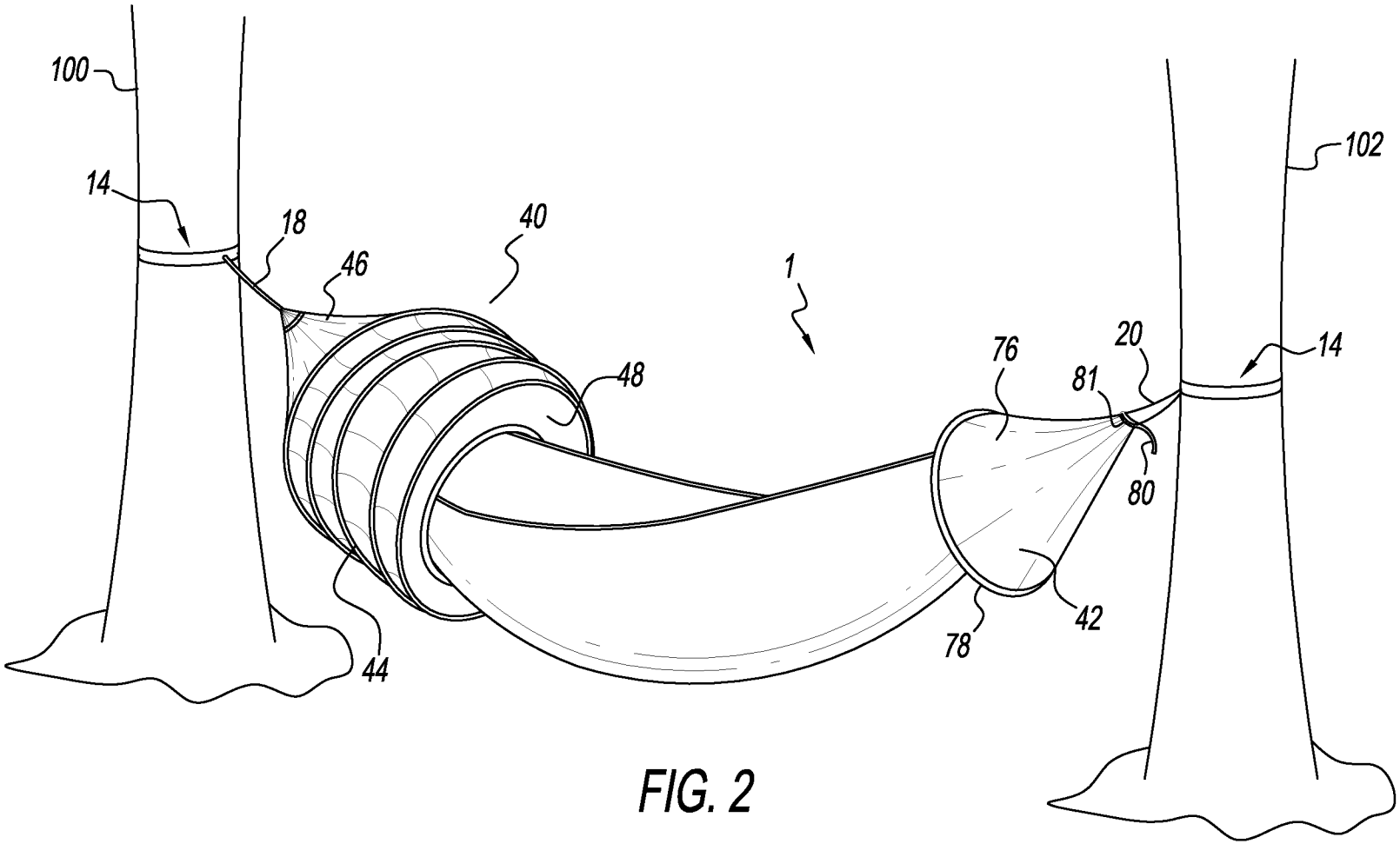
FIG. 2 is a perspective view of a hammock secured between two trees of with a collapsed height tent tube over a first end thereof and a cone over a second end of a hammock tent in accordance with the present invention.
Figure 8:
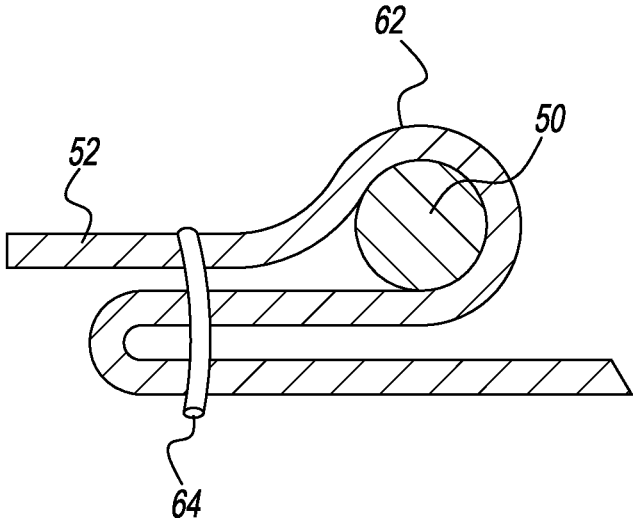
FIG. 8 is an enlarged cross sectional view of a spiral spring retained in a fabric loop of a fabric tube of a hammock tent in accordance with the present invention.

The tubular tent 12 includes a tubular member 40 and a cone member 42. The tubular member 40 includes a tube portion 44, a first end portion 46, a second end portion 48 and a spiral spring 50. The tube portion 44 preferably includes a fabric tube 52, a fabric door 54, a bottom lengthwise screen 56, at least one screen window 58 and at least one drawstring 60. An outer perimeter of the spiral spring 50 is sized to be received by an inner perimeter of the fabric tube 52. The spiral spring 50 is placed inside the fabric tube 52. With reference to FIG. 8, a loop 62 is preferably created in the fabric tube 52 over the spiral spring 50 to retain thereof along a length of the fabric tube 52. Sewing 64 is preferably used in the loop 62 to keep the spiral spring 50 substantially equal spaced along a length of the fabric tube 52. With reference to FIG. 2, the spiral spring 50 causes the tubular tent 12 to normally have a collapsed orientation or reduced length. The bottom lengthwise screen 56 is sewn into a bottom of the fabric tube 52. The first end portion 46 is sewn into a first end of the fabric tube 52 and the second end portion 48 is sewn into a second end of the fabric tube 52. The at least one screen window 58 is sewn into the fabric tube 52, adjacent the second end of the fabric tube 52. The fabric door 54 is positioned adjacent the at least one screen window 58. The fabric door 54 will cover the at least one screen window 58 in a closed position. One end of the at least one pull string 60 is attached to the first end portion 46 or a first end of the fabric tube 52. The at least one pull string 60 extends substantially a length of the fabric tube 52. The other end of the at least one pull string 60 is releasably secured to substantially a second end of the fabric tube 52.

The first end portion 46 includes a circular outer perimeter 66 and a first inner perimeter 68. The first inner perimeter 68 is sized to allow the first attachment structure 18 to be pulled therethrough. A hammock pull string 70 is sewn into the first inner perimeter 68 for cinching around the first attachment structure 18. The second end portion 48 includes a circular outer perimeter 72 and a second inner perimeter 74. The second inner perimeter 74 is sized to receive a portion of the cone member 42. The second inner perimeter 74 is sewn around an elastic material. The cone member 42 preferably includes a fabric cone 76, a round support ring 78 and a cone drawstring 80. The round support ring 78 is sewn into the circular outer perimeter 72 of the fabric cone 76. A cone inner perimeter 81 is formed in fabric cone 76. The cone drawstring 80 is sewn into the cone inner perimeter 81. The cone drawstring 80 is used to cinch around the second attachment structure 20.

Figure 3:
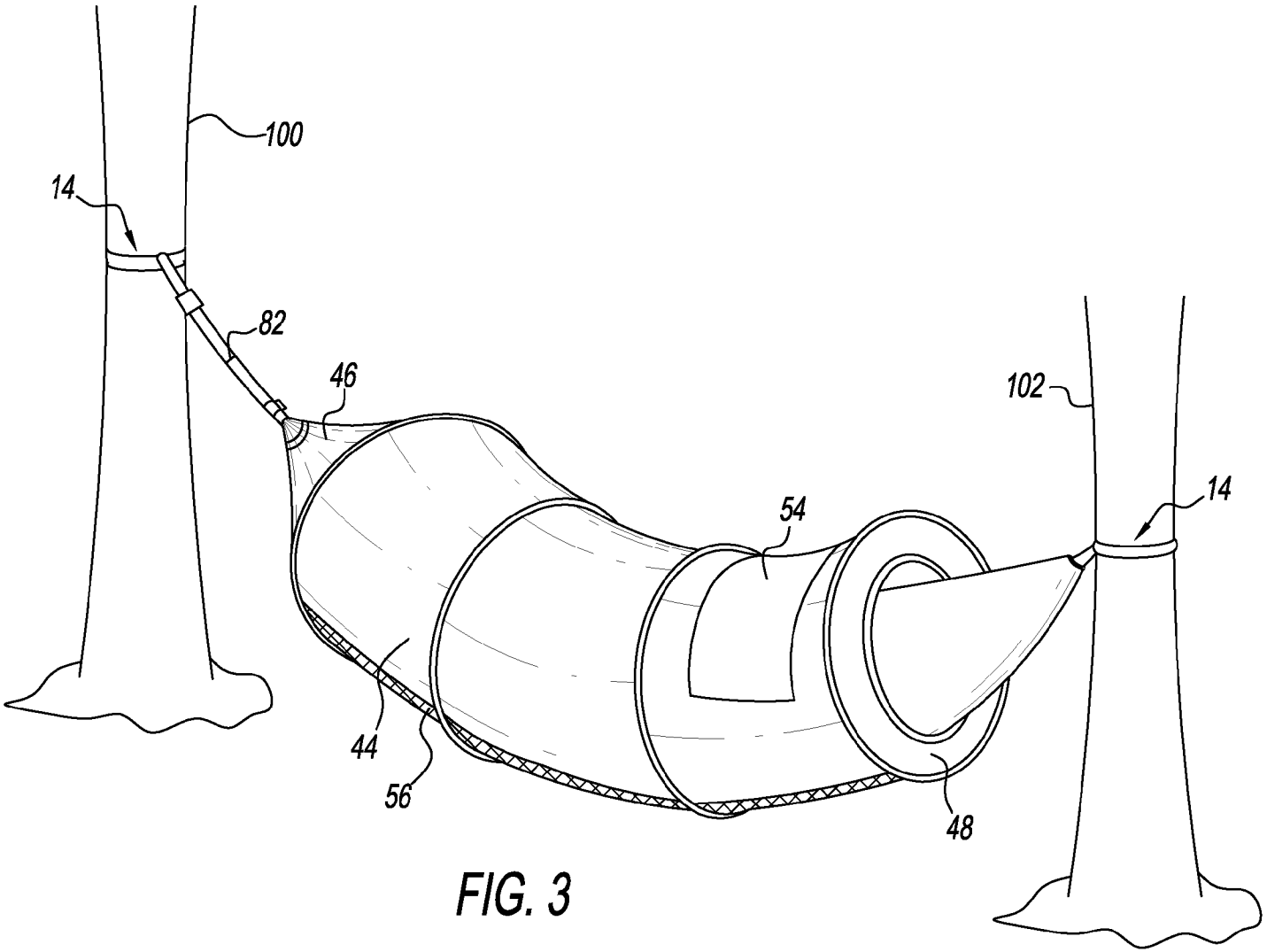
FIG. 3 is a perspective view of a tent tube covering a hammock without a cone member of a hammock tent in accordance with the present invention.
Figure 4:
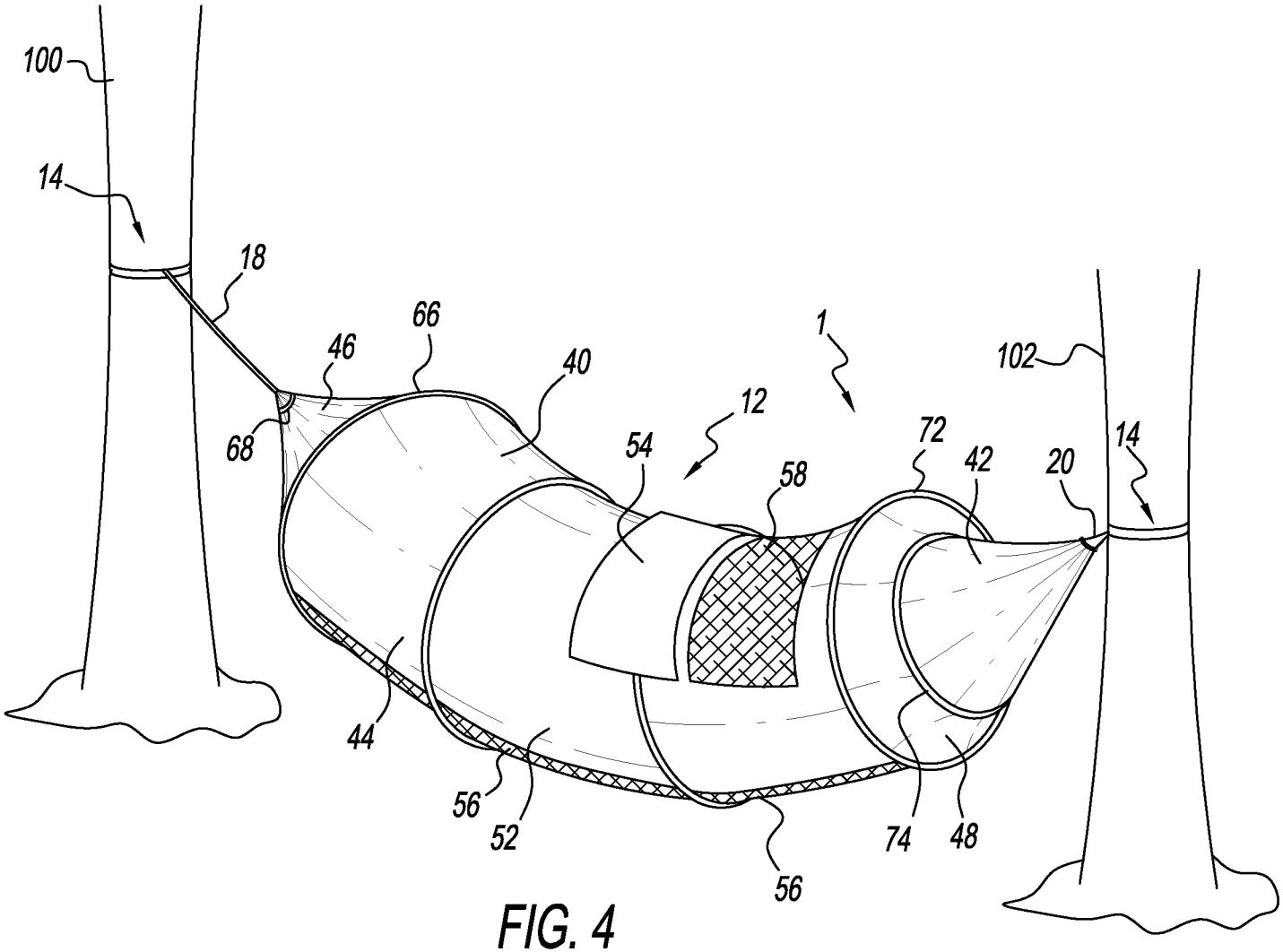
FIG. 4 is a perspective view of a tent tube covering a hammock with a cone member of a hammock tent in accordance with the present invention.

In use, the two pole anchors 14 are attached to two elevated structures or the like, such as two trees, which have a distance greater than a length of the hammock 10. With reference to FIG. 3, if the distance is substantially greater than a length of the hammock a strap 82 may be used to fill the extra distance. The hammock 10 is inserted through the tubular tent 12 and the cone member 42. The first attachment structure 18 of the hammock 10 is attached to a first tree 100 and the second attachment structure 20 of the hammock 10 is attached to a second tree 102. The user lies in the hammock 10 and may pull the normally collapsed tubular tent 12 into an elongated orientation with the at least one pull string 60. The cone member 42 is pulled through the second inner perimeter 74 of the fabric tube 52. Once the cone member 42 is positioned, the cone drawstring 80 is cinched and tightened around the second attachment structure 20. To leave the tubular tent 12, the cone member 42 is pushed out of the second inner perimeter 74 and the at least one pull string 60 is detached from an inside of the fabric tube 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A hammock tent comprising:

a hammock capable of supporting at least one adult person; and a tubular tent includes a tubular member and a cone member, said tubular member includes a tube portion, a first end portion, a second end portion and a spiral spring, said spiral spring is retained along a length of said tube portion, said spiral spring biases said tubular member to normally have a reduced length, said first end portion includes a first inner perimeter, said second end portion includes a second inner perimeter, wherein a length of said second inner perimeter is capable of being enlarged by stretching, a length of an outer perimeter of said cone member is greater than a length of said second inner perimeter when not stretched, said second inner perimeter is capable of sealing around an outer surface of said cone member, said cone member is removably retained in said second inner perimeter, said first end of said hammock extends through said first inner perimeter, said second end extends through said second inner perimeter and said cone member, wherein a first end of said hammock is attached to a first elevated structure, a second end of said hammock is attached to a second elevated structure.

2. The hammock tent of claim 1, further comprising:

at least one pull string having a first end and a second end, said first end of said at least one pull string is attached to substantially said first end of said tube portion, a second end of said at least one pull string is removably retained relative to substantially a second end of said tube portion.

3. The hammock tent of claim 1 wherein:

a first hammock pull string is retained in said first inner perimeter.

4. The hammock tent of claim 1 wherein:

an elastic material is retained in said second inner perimeter.

5. The hammock tent of claim 1 wherein:

said cone member includes a fabric cone, a support ring and a cone drawstring, said support ring is retained in an outer perimeter of said fabric cone, an inner cone perimeter is formed through said fabric cone, said cone drawstring is retained in said inner cone perimeter.

6. The hammock tent of claim 1, further comprising:

at least one screen window is formed in said tube portion; and a fabric door is positioned adjacent said at least one screen window, wherein said fabric door covers said at least one screen window in a closed position.

7. The hammock tent of claim 1 wherein:

a bottom lengthwise screen is formed in a bottom of said tube portion.

8. A hammock tent comprising:

a hammock capable of supporting at least one adult person; and a tubular tent includes a tubular member and a cone member, said tubular member includes a tube portion, a first end portion and a second end portion, said first end portion includes a first inner perimeter, said second end portion includes a second inner perimeter, wherein a length of said second inner perimeter is capable of being enlarged by stretching, a length of an outer perimeter of said cone member is greater than a length of said second inner perimeter when not stretched, said second inner perimeter is capable of sealing around an outer surface of said cone member, said cone member is removably retained in said second inner perimeter, said first end of said hammock extends through said first inner perimeter, said second end extends through said second inner perimeter and said cone member, wherein a first end of said hammock is attached to a first elevated structure, a second end of said hammock is attached to a second elevated structure.

9. The hammock tent of claim 8, further comprising:

at least one pull string having a first end and a second end, said first end of said at least one pull string is attached to substantially said first end of said tube portion, a second end of said at least one pull string is removably retained relative to substantially a second end of said tube portion.

10. The hammock tent of claim 8 wherein:

a first hammock pull string is retained in said first inner perimeter.

11. The hammock tent of claim 8 wherein:

an elastic material is retained in said second inner perimeter.

12. The hammock tent of claim 8 wherein:

said cone member includes a fabric cone, a support ring and a cone drawstring, said support ring is retained in an outer perimeter of said fabric cone, an inner cone perimeter is formed through said fabric cone, said cone drawstring is retained in said inner cone perimeter.

13. The hammock tent of claim 8, further comprising:

at least one screen window is formed in said tube portion; and a fabric door is positioned adjacent said at least one screen window, wherein said fabric door covers said at least one screen window in a closed position.

* * * * *